US008707578B2

(12) United States Patent
Jung et al.

(10) Patent No.: US 8,707,578 B2
(45) Date of Patent: Apr. 29, 2014

(54) SHEET PROCESSING MACHINE, IN PARTICULAR SHEET-FED PRINTING PRESS AND METHOD OF DRYING SHEETS

(75) Inventors: Jochen Jung, Lörrach (DE); Uwe Ernst, Mannheim (DE); Rolf Müller, Nussloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 311 days.

(21) Appl. No.: 13/310,921

(22) Filed: Dec. 5, 2011

(65) Prior Publication Data

US 2012/0137537 A1 Jun. 7, 2012

(30) Foreign Application Priority Data

Dec. 3, 2010 (DE) ..... 10 2010 053 459

(51) Int. Cl.
*F26B 3/34* (2006.01)

(52) U.S. Cl.
USPC ..... 34/267; 34/273; 101/424.1; 250/504 R; 438/26; 399/366

(58) Field of Classification Search
USPC ..... 34/267, 269, 273, 117, 121, 168, 173, 34/201, 210; 101/424.1, 488; 250/504 R; 438/26, 106, 118; 399/92, 366
See application file for complete search history.

(56) References Cited

U.S. PATENT DOCUMENTS

| | | | | | |
|---|---|---|---|---|---|
| 1,706,554 | A | * | 3/1929 | Weber | 34/500 |
| 2,236,398 | A | * | 3/1941 | Drummond | 34/60 |
| 2,391,195 | A | * | 12/1945 | Ross et al. | 34/418 |
| 2,588,966 | A | * | 3/1952 | Dale | 34/123 |
| 2,848,821 | A | * | 8/1958 | Clark et al. | 34/66 |
| 3,237,314 | A | * | 3/1966 | Smith, Jr. | 34/266 |
| 3,286,369 | A | * | 11/1966 | Smith, Jr. | 34/278 |
| 3,328,895 | A | * | 7/1967 | Krone et al. | 34/68 |
| 4,501,072 | A | * | 2/1985 | Jacobi et al. | 34/267 |
| 4,665,626 | A | * | 5/1987 | Berkmann et al. | 34/267 |
| 4,773,167 | A | * | 9/1988 | Jacobi, Jr. | 34/277 |
| 4,786,817 | A | * | 11/1988 | Boissevain et al. | 250/559.01 |
| 5,159,763 | A | * | 11/1992 | Platsch | 34/267 |
| 5,319,861 | A | * | 6/1994 | Tate | 34/267 |
| 6,293,196 | B1 | | 9/2001 | DeMoore et al. | |
| 6,647,881 | B2 | | 11/2003 | Müller et al. | |
| 7,910,899 | B2 | | 3/2011 | Platsch | |
| 7,913,622 | B2 | | 3/2011 | Pitz et al. | |
| 7,954,431 | B2 | | 6/2011 | Jung et al. | |
| 2004/0060193 | A1 | | 4/2004 | Monkewitz et al. | |
| 2006/0280825 | A1 | * | 12/2006 | Cochran et al. | 425/174.4 |
| 2009/0148620 | A1 | | 6/2009 | Petermann | |
| 2012/0005917 | A1 | * | 1/2012 | Jung et al. | 34/448 |
| 2012/0137537 | A1 | * | 6/2012 | Jung et al. | 34/267 |
| 2013/0118550 | A1 | * | 5/2013 | Sahin | 136/246 |

FOREIGN PATENT DOCUMENTS

| | | | | | |
|---|---|---|---|---|---|
| DE | 101 18 757 | A1 | | 11/2001 | |
| DE | 101 54 416 | A1 | | 5/2003 | |
| DE | 10223591 | A1 | * | 12/2003 | A45D 29/00 |
| DE | 10 2007 019 977 | A1 | | 11/2007 | |
| DE | 102006032831 | A1 | | 1/2008 | |
| DE | 10 2007 042 716 | A1 | | 4/2008 | |
| DE | 10 2006 059 025 | A1 | | 6/2008 | |
| EP | 1743775 | A1 | * | 1/2007 | B41M 1/06 |
| EP | 2 067 620 | A2 | | 6/2009 | |
| JP | 60076346 | A | | 4/1985 | |
| JP | 62117661 | A | * | 5/1987 | B05C 9/14 |
| JP | 05083904 | A | * | 4/1993 | H02K 15/12 |
| WO | 2005/093858 | A2 | | 10/2005 | |

OTHER PUBLICATIONS

German Patent and Trademark Office Search Report, Dated Jul. 12, 2011.

* cited by examiner

*Primary Examiner* — Steve M Gravini
(74) *Attorney, Agent, or Firm* — Laurence A. Greenberg; Werner H. Stemer; Ralph E. Locher

(57) ABSTRACT

A sheet processing machine, in particular a sheet-fed printing press, includes a varnishing unit and at least one combination drier for applying radiation energy and heated air to a newly varnished sheet. The at least one combination drier includes a plurality of circular or polygonal air nozzles and narrow-band high-power infrared light sources disposed between the air nozzles. The infrared light sources apply radiation at a radiation density of at least 25 kW/m$^2$ in total to the varnished sheet. The temperature of the heated air passing through the nozzles is below 100° C., preferably below 80° C. A method of drying sheets is also provided.

21 Claims, 5 Drawing Sheets

SHEET PROCESSING MACHINE, IN PARTICULAR SHEET-FED PRINTING PRESS AND METHOD OF DRYING SHEETS

CROSS-REFERENCE TO RELATED APPLICATION

This application claims the priority, under 35 U.S.C. §119, of German Patent Application DE 10 201 0 053 459.5, filed Dec. 3, 2010; the prior application is herewith incorporated by reference in its entirety.

BACKGROUND OF THE INVENTION

Field of the Invention

The invention relates to a sheet processing machine, in particular a sheet-fed printing press, including a varnishing unit and at least one combination drier for applying radiation energy in the infrared range and heated air to a newly varnished sheet. The invention also relates to a method of drying sheets.

Such combination driers for drying dispersion varnishes are known in principal. They include infrared emitters mostly in the form of thermal emitters such as carbon emitters that require preheating times of several seconds and are thus continuously switched on during the print run of a print job. It is impossible to switch such emitters on and off in accordance with the cycle of the sheet transporting system, which runs at a speed of 3 to 5 sheets per second. At the same time, hot air at a temperature of between 100° (212° F.) and 120° C. (248° F.) is blown onto the sheet to be dried. Fresh air is used for that purpose. The air may be preheated and is heated up to temperatures above 100° C. (212° F.) in a heat exchanger using electric energy.

However, only much less than 20% of the thermal energy applied in combination driers is converted into evaporation enthalpy. That is due to the fact that the hot air causes drier aggregates and all machine parts in the vicinity to heat up (heat loss). In addition, the humid, hot air is sucked away and blown into the environment after the drying process. The infrared emitters themselves have a "total efficiency" of approximately 10 to 40% depending on how well the printing material and the applied ink absorb the electromagnetic energy in wavelengths ranging between 0.5 and 10 μm emitted by conventional IR emitters. The thin, aqueous layer of dispersion varnish itself absorbs only an insignificant portion of the radiation output of the infrared emitters employed for that purpose.

Attempts have been made to improve the total efficiency of such combination driers by providing additional devices such as heat exchangers for recycling thermal energy from the exhaust air to re-use it to heat up the fresh air. Such measures, however, do not recover more than 10% of the output of the drier.

Furthermore, attempts have been made to shift the emission wavelength to the long-wavelength range of the IR spectrum using known types of thermal emitters such as ceramic tiles, heated bands of metal, etc. However, the operating temperature of such emitters remains between 500° C. (932° F.) and 800° C. (1472° F.), causing a high amount of energy to be lost as waste heat due to forced and free convection. Another drawback is that the sheets must be prevented from contacting the hot surfaces of the drier components since paper starts to burn at 200° C. (392° F.). In addition, it is difficult to keep the heat of the driers away from other machine parts. Partitions and encapsulations have virtually no effect. Thus, neighboring machine components that must not be subject to the heat emanating from the drier sometimes require elaborate recooling measures.

The modest degree of efficiency of combination driers is largely due to the fact that it is difficult to get the energy of the heat sources of the drier to precisely the location where it is needed, i.e. to evaporate the water in the layer of dispersion varnish. The reason therefor is assumed to be that too little heat is transferred from the hot air to the surface of the sheet. Consequently, attempts have been made to improve the degree of efficiency by optimizing the nozzles and the temperature range of the hot air. German Published Patent Application DE 10 2007 019 977, corresponding to U.S. Patent Application Publication No. US 2007/0266872, for instance, describes a hot-air drier in which the temperature of the hot air is to be 300° C. (572° F.) at the minimum and the distance between the sheets and the nozzles is to be as short as possible. However, that device suffers from the drawback that due to the short distance and the high expulsion speed of the hot air, the varnish that is to be dried is virtually blown away without having a chance to form a uniform and smooth layer of varnish. German Published Patent Application DE 10 2006 059 025 and U.S. Patent Application Publication No. US 2004/0060193 A1 and U.S. Pat. No. 6,293,196 disclose the provision of nozzles that emit turbulent streams of hot air at a high speed to achieve better interaction with the sheet surface. However, those measures are likewise of only limited success.

Machines for processing sheets which use UV inks and UV varnishes are known in the art. The UV inks and varnishes can be cold-dried, i.e. reactively linked using UV radiators. Those driers do not require the additional application of hot air. Instead, they may require cooling air to cool the UV light sources themselves. International Publication No. WO 2005/093858, corresponding to U.S. Pat. No. 7,910,899, for instance, describes a two-dimensional UV light source in which a matrix of diodes emitting ultraviolet light is inserted. Those diodes are cooled by air that passes through slit-shaped channels between the rows of diodes. However, such UV light sources are not suitable for drying aqueous dispersion varnishes.

European Patent Application EP 2 067 620, corresponding to U.S. Patent Application Publication No. US 2009/0148620, discloses a method for cycle-operated drying of a printed sheet based on UV or IR semiconductor light sources. The disclosed method relates to the drying of printing ink that is provided with absorbers for the emission wavelengths of the semiconductor light sources. In order to dry water-based varnishes, the document proposes to provide a separate conventional hot-air drying tower.

SUMMARY OF THE INVENTION

It is accordingly an object of the invention to provide a sheet processing machine, in particular a sheet-fed printing press, and a method of drying sheets, which overcome the hereinafore-mentioned disadvantages of the heretofore-known machines and methods of this general type and which provide a combination drier for drying dispersion varnishes that makes efficient use of employed energy and has a particularly high degree of overall efficiency.

With the foregoing and other objects in view there is provided, in accordance with the invention, a sheet processing machine, in particular a sheet-fed printing press, comprising a varnishing unit and at least one combination drier for applying radiation energy and heated air to a newly varnished sheet. The at least one combination drier includes a multiplicity of round, circular or polygonal air nozzles guiding the heated air passing through the nozzles at a temperature below 100° C., preferably below 80° C., and narrow-band high-power infrared light sources disposed between the nozzles for applying a total irradiation density of at least 25 kW/m$^2$ to the varnished sheet.

The present invention is based on the realization that it is expedient to generate the energy to be applied to the layer of dispersion varnish to evaporate the water almost completely by infrared radiation, which is adapted to the absorption spectrum of the varnish. The blown air that is simultaneously directed to the sheet merely acts to remove, i.e. blow away the water vapor released from the varnish by the infrared radiation. For this purpose, air of a relatively low temperature is sufficient. Due to these measures, the heat transfer coefficient $\alpha$ can be increased by a factor 2 at the minimum up to a factor of 5, compared to the aforementioned known combination driers, i.e. values of $\alpha$>250 W/m$^2$K can be attained. Due to the high degree of air exchange and the strong flow of air over the surface of the varnished sheet, the water vapor is prevented from accumulating or condensing (creation of mist), thus in turn preventing the applied infrared light from being absorbed by the vapor before it reaches the surface of the sheet.

The heated air used for this purpose preferably has a temperature of between 40° C. (104° F.) and 80° C. (176° F.). This temperature range is sufficient to ensure that the air can absorb the water evaporating from the sheets.

The wavelength of the infrared light sources is expediently adapted to the absorption bands of the dispersion varnish, i.e. to the absorption bands of water at 1.93, 2.7, 4.7 and/or 6.3 μm.

The combination drier of the invention is advantageously disposed above a cylinder of the varnishing unit, i.e. above the impression cylinder of the varnishing unit or above a downstream cylinder for transporting the sheet towards the delivery. High-performance blowers such as lateral channel blowers or peripheral turbo blowers or high-pressure radial fans are expediently used to supply air. Such blowers are manufactured by Gardner Denver Schopfheim GmbH in Schopfheim, Federal Republic of Germany, or Dietz Motoren GmbH+Co. KG in Dettingen u. Teck, Federal Republic of Germany. They generate a static pressure of more than 8,000 Pa and provide amounts of air of between 1,000 and 2,000 m$^3$/h, which can be increased as desired by using multiple blowers. The required amount of air is at least approximately 3000 m$^3$ air per square meter of sheet surface per hour and amounts of air in a range between 5,000 and 15,000 m$^3$ of air per square meter of sheet surface per hour are expedient. In this context, "sheet surface" denotes the area of the sheet that is in the drier zone, i.e. if the sheet has a width of 1.05 m (approximately 3.44 feet) and the drier zone a length of 0.27 m (approximately 0.89 feet), the sheet area that is subjected to the radiation and blown air is 1.05×0.27 m$^2$=0.28 m$^2$ (approximately 3 square feet).

It has been found to be expedient for the ratio between the infrared light output acting on the sheet in the drier and the air flow to be maintained within a certain range. Considering reasonable values for the temperature of the blown air, the geometry of the nozzle field and its distance to the sheet and the blowing speed, the aforementioned ratio is between 2 and 20 Watt hours per cubic meter of air, preferably between 2.5 and 12.5 Watt hours per cubic meter of air.

Below the lower limits, it is difficult to achieve a sufficient degree of drying. Above the upper limit, it is difficult to maintain the temperature of the sheet on a sufficiently low level and to absorb and remove the evaporated humidity.

The infrared light sources that emit at the absorption bands of water may be IR/diode lasers or diode laser arrays. Both edge-emitting high-power diode lasers and surface-emitting diode lasers or laser arrays such as high-power VCSEL laser arrays may be used. It is also possible to use fiber-coupled diode lasers.

Due to the low temperatures of the exhaust air of the drier of the invention and the large amounts of vapor expelled by the diode laser, the exhaust air is relatively easy to be cooled down to below the dew point and thus to condense and wash away the water and potential other solvents (ammonia). Thus, it is possible to provide a zero-emission combination drier.

If the infrared radiators are expediently constructed as semiconductor light sources, they may easily be switched on and off in accordance with the format of the sheets and the sheet feeding cycle by using a suitable control device. Thus, the light sources are switched off when a gap occurs between sheets, which is a measure which may double the efficiency of the drier all by itself. In addition, due to the measures proposed by the invention, a drier requires much less structural length than conventional combination driers of the aforementioned type.

With the objects of the invention in view, there is concomitantly provided a method of drying sheets varnished with aqueous varnish in a sheet processing machine. The method comprises subjecting the sheets to be dried to infrared radiation from narrow-band infrared light sources having wavelengths lying at least at one absorption band of water and having an infrared radiation density of at least 25 kW/m$^2$, in at least one combination drier, and simultaneously subjecting the sheets to a blown air flow of at least 3,000 m$^3$ of air per m$^2$ of sheet surface per hour with a temperature of the blown air of less than 100° C., preferably less than 80° C., in the at least one combination drier.

Other features which are considered as characteristic for the invention are set forth in the appended claims.

Although the invention is illustrated and described herein as embodied in a sheet processing machine, in particular a sheet-fed printing press, and a method of drying sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
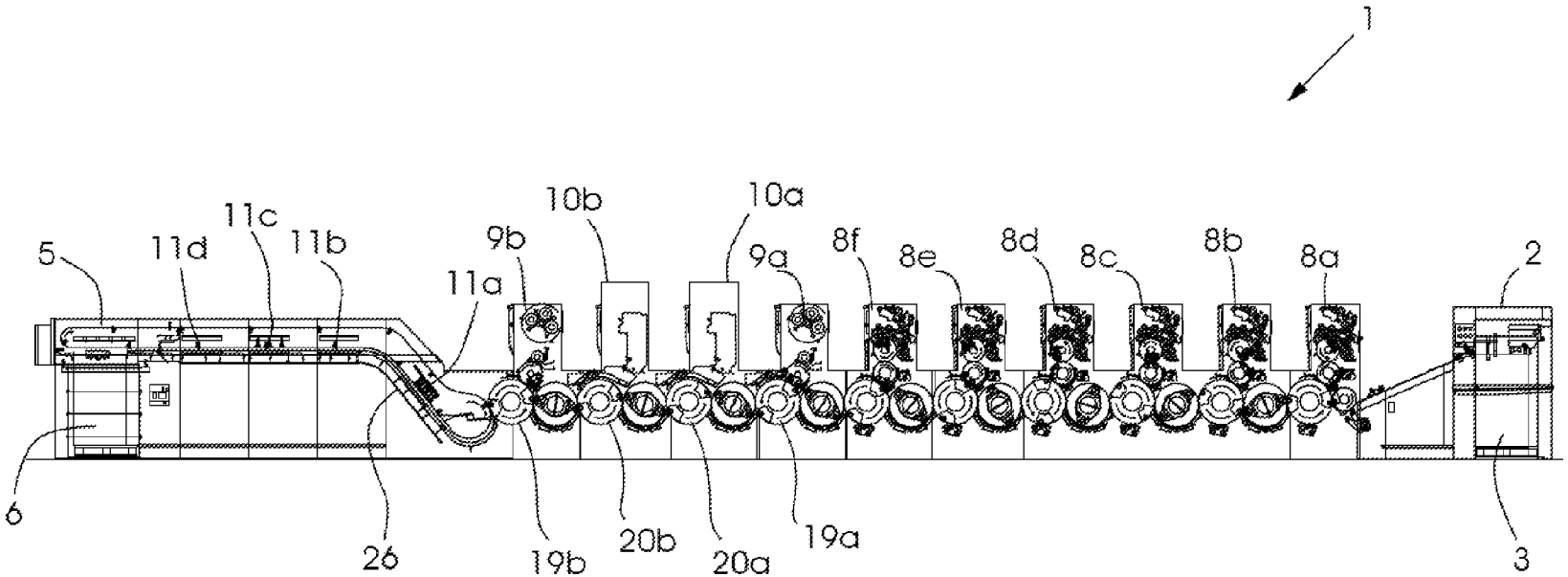
FIG. 1 is a diagrammatic, longitudinal-sectional view of an offset printing press.

Referring now to the figures of the drawings in detail and first, particularly, to FIG. 1 thereof, there is seen a lithographic offset printing press 1 of in-line construction including a feeder 2 that contains a stack 3 of unprinted sheets, six printing units 8*a* to 8*f* for the four process colors and two additional special colors if desired, a first varnishing unit 9*a* followed by two drier units 10*a* and 10*b*, a second varnishing unit 9*b* and a delivery 5 with a stack 6 of delivered sheets. Four additional drier units 11*a* to 11*d* disposed in succession, as viewed in the direction of sheet transport, are provided in the region of chain guides of the delivery 5. Sheet-transporting cylinders 20*a*, 20*b* and impression cylinders 19*a*, 19*b* of the varnishing units are also shown.

A printing press of this kind is available, for instance, from Heidelberger Druckmaschinen AG under the name of Speedmaster XL105-6-LYYLX3.

The four drier units 11*a* to 11*d* may be embodied as insertion modules as described in German Published Patent Application DE 101 18 757 A1, corresponding to U.S. Pat. No. 6,647,881. These drier inserts are of the type known as combination driers, which act on the sheet to be dried by using hot air and radiation energy such as IR radiation.

Figure 2:
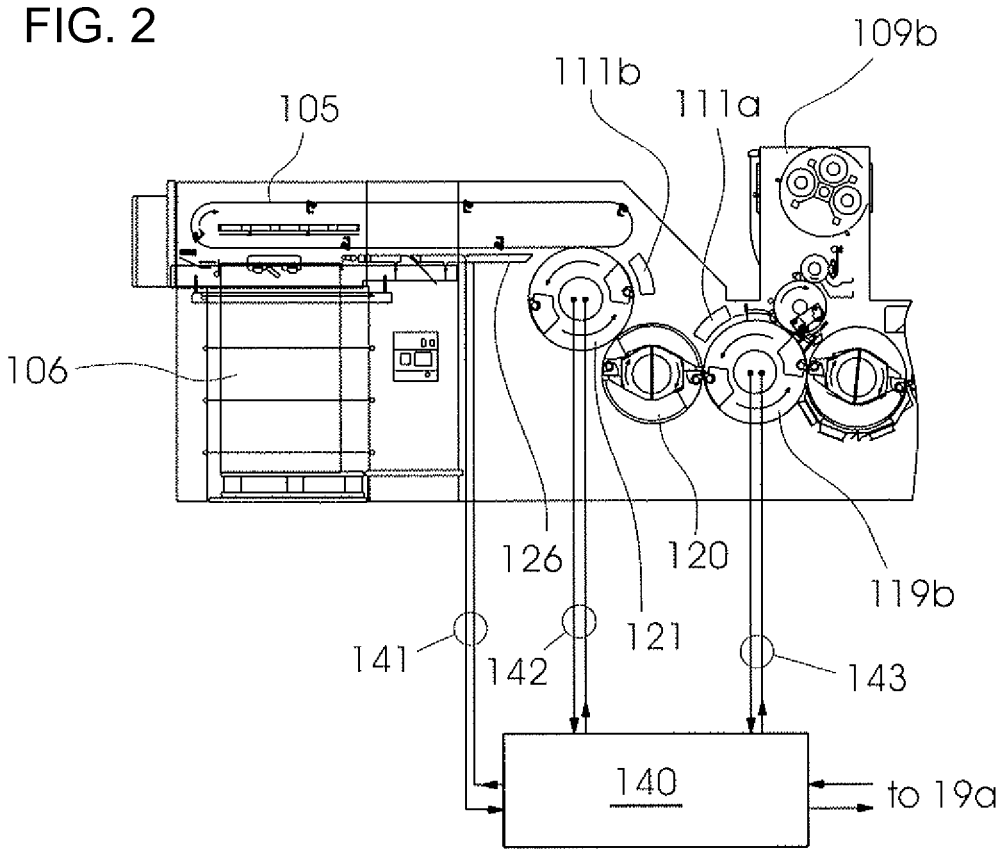
FIG. 2 is an enlarged, fragmentary, longitudinal-sectional view of a first embodiment of a rear part of the printing press with combination driers.

FIG. 2 shows a first exemplary embodiment of the rear part of the machine shown in FIG. 1. However, the printing press shown in FIG. 2 includes a modified drier section including combination driers in accordance with the invention. A varnishing unit 109*b*, or rather its impression cylinder 119*b*, is followed by first and second transport cylinders 120 and 121. The cylinder 120 is constructed in a known fashion as a transfer drum which ensures that the varnished sheet surface facing inward does not contact the cylinder surface. Air cushions are provided to keep the sheet surface away from the cylinder surface, whereas the surface of the transport cylinder 121 may be in contact with the back of the sheet, which has already been dried, and indeed rests on the surface of the transport cylinder 121. The cylinders 120 and 121 convey the sheet to a revolving chain gripper system 105, which in turn conveys the varnished sheet to a location above a stack 106, in a known fashion, to be deposited thereon. Reference numeral 126 designates a sheet-guiding plate over which the chain grippers pull the sheet without contact due to air cushions.

A first combination drier 111*a* including a curved nozzle plate adapted to the radius of the cylinder is provided on the printing cylinder 119*b* at a spacing of between approximately 1 cm and approximately 4 cm (see the following exemplary numerical embodiments 1 and 2). The structure of this drier will be described with reference to the following figures. A second combination drier 111*b* is associated with the second transport cylinder 121 and mounted at the same distance from the cylinder surface.

The sheet-guiding cylinders 119*b*, 121 and/or the sheet-guiding plate 126 have cooling circuits 141, 142, 143 expelling exhaust heat which is fed to a sheet-guiding cylinder and/or impression cylinder 19*a* (FIG. 1) disposed upstream of the combination driers 111*a-c* in a sheet transport direction for pre-heating the sheets to be dried.

Figure 3:
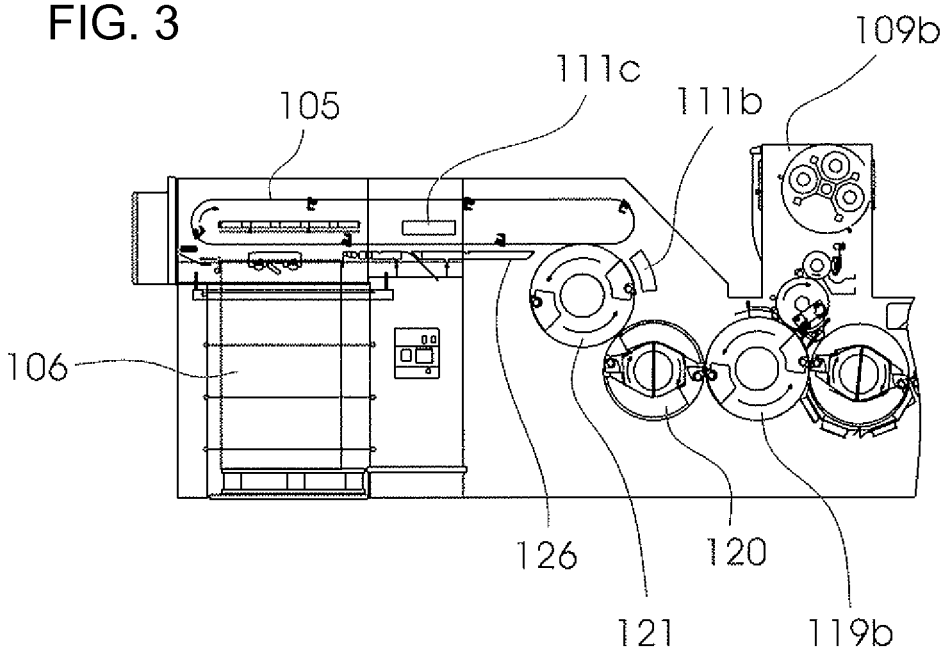
FIG. 3 is a fragmentary, longitudinal-sectional view of a second embodiment of a rear part of the printing press with combination driers.

In accordance with a second, alternative exemplary embodiment shown in FIG. 3, a second combination drier 111*c is* provided above the sheet-guiding plate 126 instead of the combination drier 111*a* provided at the printing cylinder 119*b* of the varnishing unit 109*b*. This combination drier has a rectangular, planar shape. In every other respect, identical components have identical reference numerals and will not be explained again in any detail.

Figure 4:
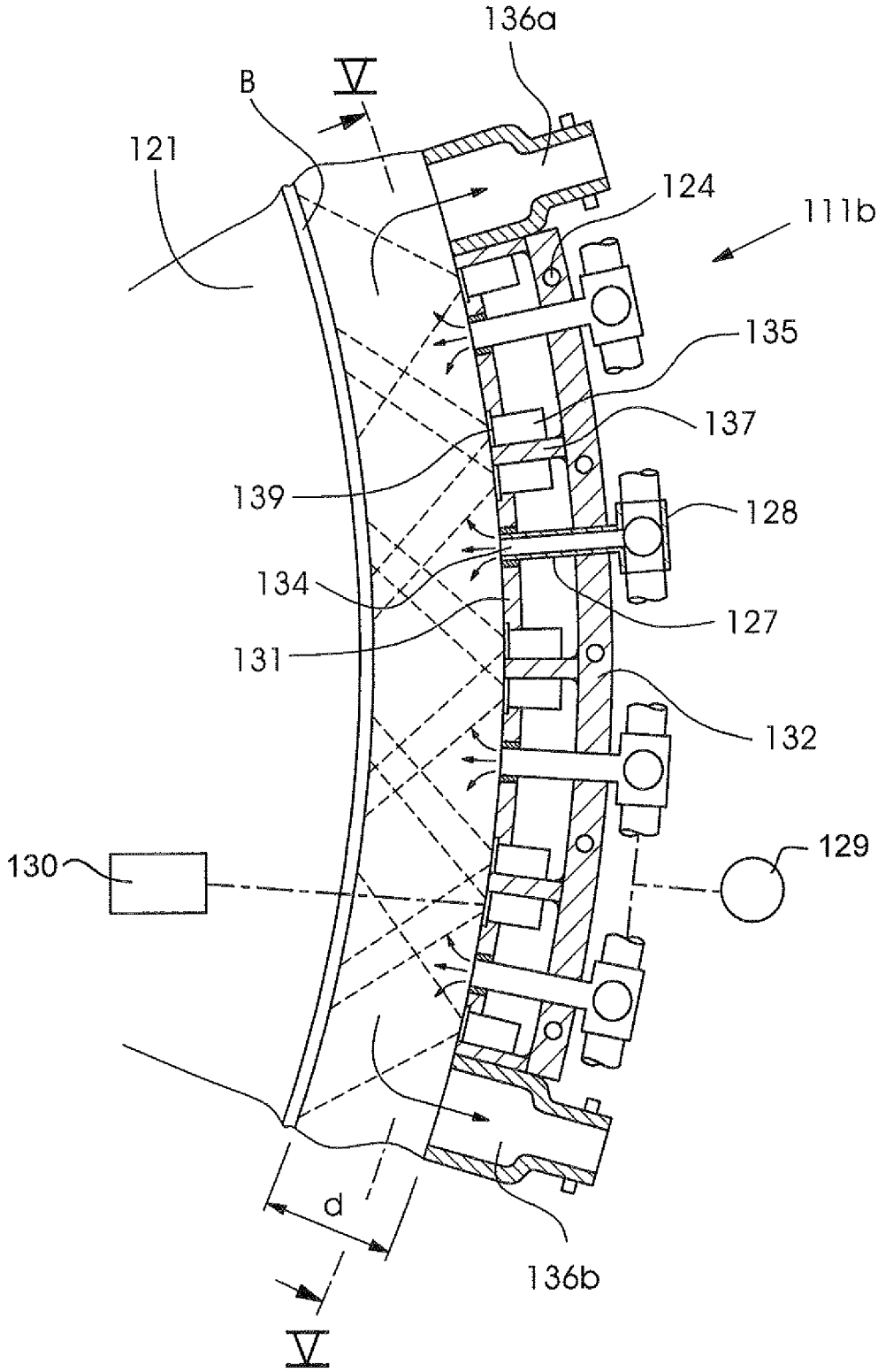
FIG. 4 is a further enlarged, fragmentary, cross-sectional view of a combination drier with nozzles and laser diodes, which is taken along a line IV-IV of FIG. 5, in the direction of the arrows.

FIG. 4 is a more detailed sectional view of the combination drier 111*b* taken along a line perpendicular to the axis of the transport cylinder 121. It has a concave shape adapted to the curvature or radius of the cylinder surface.

Figure 5:
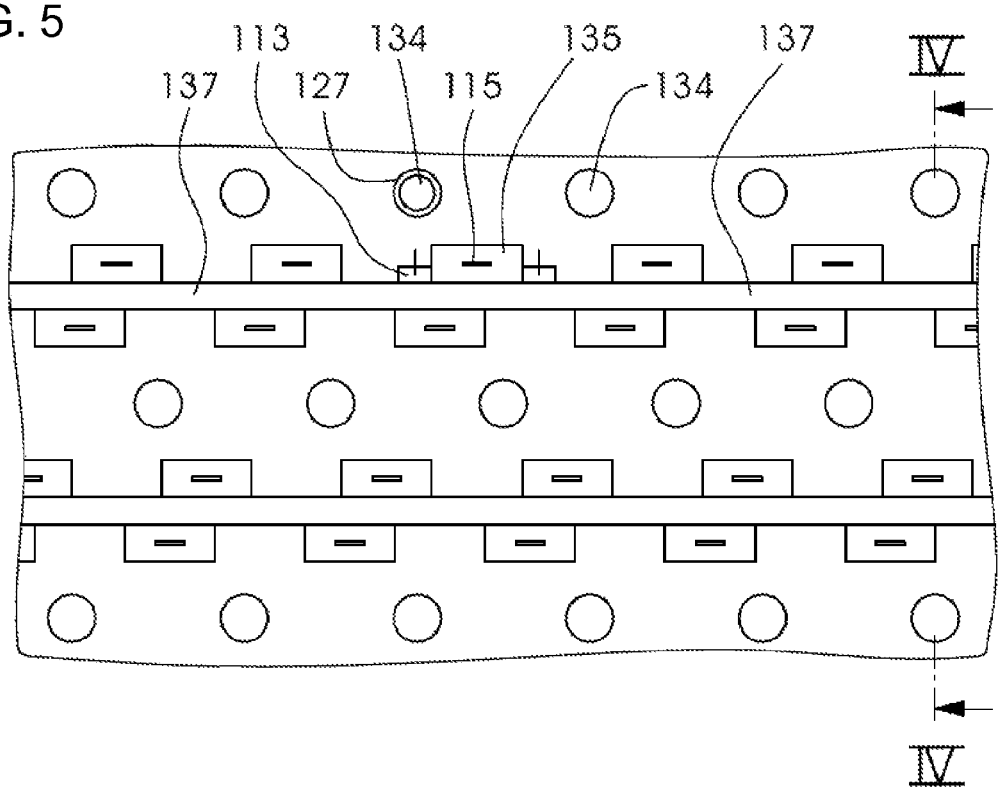
FIG. 5 is a fragmentary, elevational view of the combination drier with the nozzles and laser diodes, which is taken along a line V-V of FIG. 4, in the direction of the arrows.
Figure 7:
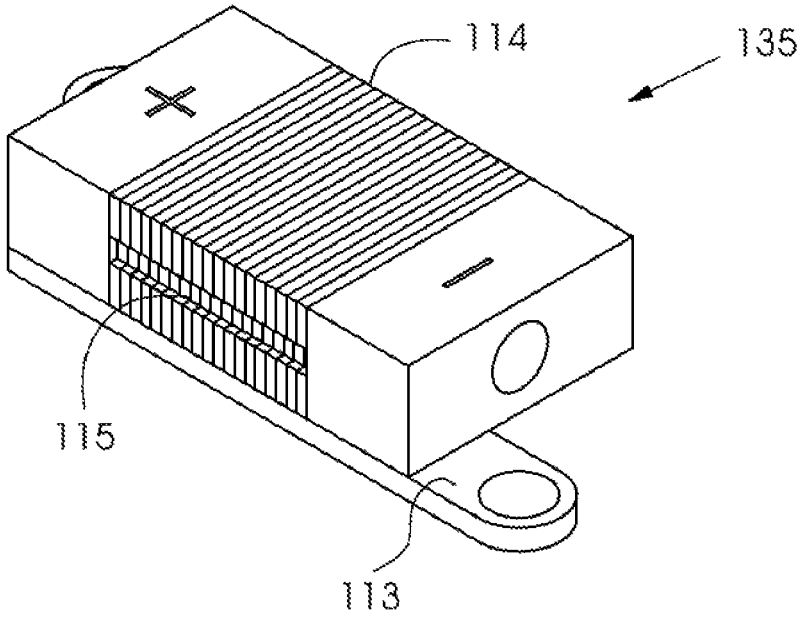
FIG. 7 is an enlarged, perspective view of a laser diode having a vertical stack of laser bars.

As is apparent from the elevational view of the section shown in FIG. 5, in which a plate 131 has been removed, the combination drier includes multiple rows of nozzles 134 through which air may pass and which are offset relative to each other. Multiple high-power diode lasers 135 are inserted into gaps between the nozzles in a chessboard-like configuration so as to be offset relative to the nozzles 134. The diode lasers 135 are embodied as a so-called vertical stack of laser bars, i.e. up to 30 and typically 6, 12 or 20 individual bars 114 are combined and mounted on a cooling body. Such a stack formed of 12 bars is shown in FIG. 7. The cooling body is designated by reference numeral 113. A zone that emits the infrared radiation is designated by reference numeral 115. Such diode lasers are principally known and are available, for example, from the DILAS Company based in Mainz, Germany. The cooling bodies 113 of the diode lasers 135 are attached to webs 137 (shown in FIG. 4) that extend between the nozzle plate 131 and a rear wall 132 of the drier 111*b*. The webs 137, like the rear wall 132, are made of aluminum and are interconnected by a material having good thermal conductivity. Together with the rear wall, they form a cooling body for the diode laser bars 135. In the rear wall 132, coolant channels or circuits 124 are provided through which a coolant flows to remove heat lost by operation of the diode lasers.

This structure provides a way to maintain the temperature of the diode laser bars 114 mounted to the cooling body within a temperature range of between 20 and 25° C. (between 68° F. and 77° F.) in which the emission of radiation is optimized.

Small plastic tubes 127 are inserted into nozzle bores of the plate 131. These plastic tubes 127 supply blown air required to blow away water vapor emanating from the layer of varnish on a sheet B that is subject to the radiation, in order to ensure that the vapor does not cause premature absorption of the infrared radiation above the sheet surface. These plastic tubes 127 are interconnected by a distribution system 128 and are supplied with blown air at a pressure of 8000 Pa by schematically illustrated compressors 129, such as the side channel blowers mentioned above. The temperature of the blown air is approximately 50° C. (122° F.). This temperature is sufficient to absorb and remove the water vapor created between the drier and the irradiated sheet, yet low enough not to cause too much thermal energy to be lost. The moderate temperature of the blown air additionally ensures that no water condensation occurs in the region of the drier 111*b* itself.

The blown air is heated up by using a non-illustrated water/air heat pump connected to the coolant circuit 124 to transform the exhaust heat of the diode lasers amounting to approximately 25° C. (77° F.) to a higher temperature level of between 50° C. (122° F.) and 60° C. (140° F.) and to transfer it to a non-illustrated heat exchanger through which the supply air passes. In this context it should be noted that the air has already been heated up by 7° C. (12.6° F.) due to the adiabatic compression in the side channel blowers and that the exhaust heat of the compressors/blowers may also be used to heat up the blown air. An additional electric heating device for heating up the blown air as required in conventional driers is not necessary.

Since the blown air is guided through the rear wall 132 and the plate 131 by the tubes 127, which are made of a plastic material having low thermal conductivity, the warm air remains thermally isolated from the diode lasers 135 to prevent it from impairing their efficiency. Furthermore, radiation windows 139, made of a plastic that is transparent for the wavelength of the diode lasers, are inserted in front of the diode lasers 135. These windows 139 smoothly close off the plate 131 and the interior space located behind the windows 139 to prevent them from being contaminated by entering humidity and dirt. Thus, the plate 131 and the drier as a whole forms a sheet-guiding body with a smooth surface, except for the nozzle bores. The air stream exiting from the ends of the small plastic tubes 127 presses the sheet to be dried onto the impression or transport cylinder 119*b*/121.

At a given angle of divergence of the radiation of the diode lasers 135, the number of the diode lasers 135 and the spacing of the nozzle bores 134 from the surface of the cylinder 121 and the sheet B resting thereon are selected in such a way as to ensure that infrared radiation is intensively applied to the entire surface of the sheet conveyed below the drier while the turbulent air flow that exits from the plastic tubes 127 at the same time blows away the water vapor that evaporates from the layer of varnish on the sheet B. The steamy exhaust air has a temperature of approximately 60° C. (140° F.) to 70° C. (158° F.) and is collected on both sides of the drier and perpendicular to the direction of sheet-transport through extraction channels 136*a* and 136*b*. From there, the exhaust air is either blown into the environment through non-illustrated exhaust ducts or, in accordance with a further development of the invention, it may be recycled after condensing out the water vapor and potential solvents contained therein.

High-power infrared diode lasers that emit on the absorption line of water at 1.93 μm are known in the art. They are manufactured, for example, by the aforementioned DILAS company and are described in the article entitled "High Power Diode Laser Modules From 410-2200 nm" (by Bernd Köhler et al.) of DILAS GmbH. The individual bars have an electric output power of 15 W. Thus, using approximately 50 stacks of 12 bars each, an infrared power of 9 kW on the absorption line of water can be attained.

The electric connectors of the high-power diode lasers 135 are installed in a connecting socket that is connected through corresponding wiring to a mains adapter of a drier control 130 in a supply cabinet for the drier on the printing press. The drier control provides the output current or output voltage for the diode lasers 135 in synchronism with the machine angle. For this purpose, the drier control is connected to the control of the printing press to receive information on the current machine angle and further real-time lead commands. Consequently, a voltage is applied to the diode lasers 135 only when the varnished sheet passes the cone of divergence of the diode lasers underneath the latter. For this purpose, the diode lasers are switchable in groups, i.e. the diode lasers in those rows that the sheet will pass at a later point in time will be switched on later. In addition, outer groups of diode lasers can be separately switched on and off. These outer diode lasers are switched off when the processed paper is smaller than the maximum format.

The tables below list the actual dimensions of two exemplary embodiments of the drier of the invention in a printing press of the 74×105 cm sheet format.

Example 1

| | |
|---|---|
| Nozzle field | 95 nozzles in 5 rows of 19 nozzles each |
| Diameter of the nozzles | 8 mm |
| Nozzle cross-section of an individual nozzle | 50 $mm^2$ |
| Total cross-section of the nozzles | 4750 $m^2$ |
| Spacing between nozzles/rows of nozzles | 5.6/5 cm |
| Temperature of the blown air | 50° C. |
| Blowing speed | 175 m/s |
| Volume flow of air V_pkt | 3000 $m^3/h$ |
| Spacing between nozzle opening and sheet of paper | 4 cm |
| Infrared radiation power at $\lambda = 1.93$ μm | 9 kW |
| Width of the drier zone | 105 cm |
| Length of the drier zone | 27 cm |
| Radiation density | 35 $kW/m^2$ |
| V_pkt/A | 10600 $m^3$ [air]/($m^2$ h) |
| Heat transfer coefficient α | 500 W/($m^2$ K) |
| Ratio of radiation density/V_pkt/A | 3.3 $Wh/m^3$ |

A drier with these specifications was found to be capable of pre-drying sheets of paper having a weight which is 135 $g/m^2$ and which are varnished by using aqueous varnish amounting to 4 $g/m^2$ at a printing speed of 4.9 m/s to a degree of dryness of 55% as the sheets pass through the drying section. If a drier with the same construction is provided on the sheet-transport cylinder after the next, the passing sheet would reach a degree of dryness of 98%.

Increasing the blown-air temperature from 50° C. to 70° C. (122° F. to 158° F.) would increase the degree of dryness to 60%. Thus, in this case too, a second drier was used to complete the drying process. In the first case, the temperature of the sheet after passing through both driers was 38° C. (100.4° F.), in the second case it was 43° C. (109.4° F.). Thus, no additional measures to cool the sheet after the drying process were necessary.

Example 2

| | |
|---|---|
| Nozzle field | 1672 nozzles in 22 rows of 76 nozzles each |
| Diameter of the nozzles | 2 mm |
| Nozzle cross-section of an individual nozzle | 3.14 $mm^2$ |
| Total cross-section of the nozzles | 5250 $mm^2$ |
| Spacing between nozzles/rows of nozzles | 14 mm |
| Temperature of the blown air | 50° C. |
| Blowing speed | 120 m/s |
| Volume flow of air V_pkt | 2270 $m^3/h$ |
| Spacing between nozzle opening and sheet of paper | 1 cm |
| Infrared radiation power at $\lambda = 1.93$ μm | 20 kW |
| Width of the drier zone | 105 cm |
| Length of the drier zone | 30 cm |
| Radiation density | 67 $kW/m^2$ |
| V_pkt/A | 7570 $m^3$ [air]/($m^2$ h) |
| Heat transfer coefficient α | 620 W/($m^2$ K) |
| Ratio of radiation density/V_pkt/A | 8.8 $Wh/m^3$ |

A drier with these specifications was found to be capable of attaining a degree of dryness of 95% after one passage. The temperature of the sheet after drying was 42° C. In this case, no second drier was required.

Further embodiments are conceivable in accordance with the scope of the invention. For instance, the drier 111*c* having a similar construction to the drier 111*b*. The only difference is that the drier 111*c* is flat instead of concave.

Of course, the drier towers 10*a* and 10*b* provided downstream of the first varnishing unit 9*a* in the printing press shown in FIG. 1 may also be equipped with the driers 11*a* and/or 111*b* of the invention, for example by placing the driers above the sheet-transporting cylinder 20*a*. If the drier has suitable dimensions, for instance those of the drier in accordance with the second example, the drier tower 10*b* may be dispensed with.

Figure 6:
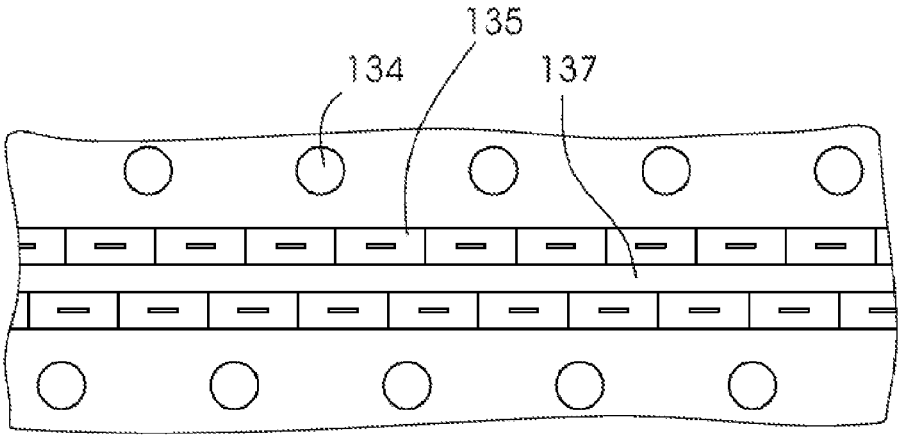
FIG. 6 is a fragmentary, elevational view of the combination drier having a different configuration of the laser diodes.

Instead of the diode laser bars that are alternatingly offset between the nozzles, it is also possible to provide diode laser arrays that follow each other immediately across the entire width of the sheets and alternate with corresponding nozzle rows in the direction of sheet travel as indicated in FIG. 6.

Finally, the infrared light output may be provided to the drier by light-conducting fibers having ends which are fixed in the plate 131. In this case, the high-power diode lasers may be disposed in the supply cabinet of the drier of the printing press.

The invention claimed is:

1. A sheet processing machine, comprising:

a varnishing unit; and at least one combination drier for applying radiation energy and heated air to a newly varnished sheet, said at least one combination drier including:

a multiplicity of circular or polygonal air nozzles guiding the heated air passing through said nozzles at a temperature below 100° C., and narrow-band high-power infrared light sources disposed between said nozzles for applying a total irradiation density of at least 25 kW/m$^2$ to the varnished sheet.

2. The sheet processing machine according to claim 1, wherein the sheet processing machine is a sheet-fed printing press.

3. The sheet processing machine according to claim 1, wherein the temperature of the heated air passing through said nozzles is below 80° C.

4. The sheet processing machine according to claim 1, which further comprises a sheet-guiding cylinder and a sheet-guiding plate, said nozzles being disposed at a distance of less than 50 mm above said sheet-guiding cylinder or said sheet-guiding plate.

5. The sheet processing machine according to claim 1, which further comprises a sheet-guiding cylinder and a sheet-guiding plate, said nozzles being disposed at a distance of between 10 mm and 40 mm above said sheet-guiding cylinder or said sheet-guiding plate.

6. The sheet processing machine according to claim 1, which further comprises at least one high-pressure blower connected to said nozzles for creating a turbulent air flow above the sheet having a total of at least 3,000 m$^3$ of air per m$^2$ of sheet surface per hour at a sheet speed of 5 m/s.

7. The sheet processing machine according to claim 6, wherein said high-power infrared light sources and said at least one high-pressure blower have at least one of an amount or an output selected to set a ratio of infrared radiation energy per cubic meter of applied blown air of between 2 Watt hours per cubic meter of air and 20 Watt hours per cubic meter of air.

8. The sheet processing machine according to claim 7, wherein said ratio is between 2.5 and 12.5 Wh/m$^3$.

9. The sheet processing machine according to claim 1, wherein said infrared light sources have emission wavelengths corresponding to one or more wavelengths of absorption bands of water at least at one of 1.93, 2.7, 4.7 or 6.3 μm.

10. The sheet processing machine according to claim 1, wherein said infrared light sources are semiconductor light sources.

11. The sheet processing machine according to claim 1, wherein said infrared light sources are IR diode lasers or diode laser arrays.

12. The sheet processing machine according to claim 11, which further comprises a control connected to said infrared light sources for switching said IR diode lasers on and off in accordance with at least one of a sheet format or a cycle of a sheet conveying movement.

13. The sheet processing machine according to claim 4, which further comprises cooling circuits each cooling a respective one of said sheet-guiding cylinder or said sheet-guiding plate and expelling exhaust heat being fed to a sheet-guiding cylinder disposed upstream of said at least one combination drier in sheet transport direction for pre-heating the sheets to be dried.

14. The sheet processing machine according to claim 5, which further comprises cooling circuits each cooling a respective one of said sheet-guiding cylinder or said sheet-guiding plate and expelling exhaust heat being fed to a sheet-guiding cylinder disposed upstream of said at least one combination drier in sheet transport direction for pre-heating the sheets to be dried.

15. The sheet processing machine according to claim 10, which further comprises a cooling circuit of a heat pump for heating the blown air, and at least one cooling body connected to said cooling circuit, said infrared light sources being mounted to said at least one cooling body.

16. The sheet processing machine according to claim 11, which further comprises a cooling circuit of a heat pump for heating the blown air, and at least one cooling body connected to said cooling circuit, said infrared light sources being mounted to said at least one cooling body.

17. A method of drying sheets varnished with aqueous varnish in a sheet processing machine, the method comprising the following steps:

subjecting the sheets to be dried to infrared radiation from narrow-band infrared light sources having wavelengths lying at least at one absorption band of water and having an infrared radiation density of at least 25 kW/m$^2$, in at least one combination drier; and simultaneously subjecting the sheets to a blown air flow of at least 3,000 m$^3$ of air per m$^2$ of sheet surface per hour with a temperature of the blown air of less than 100° C., in the at least one combination drier.

18. The method according to claim 17, which further comprises setting the temperature of the blown to less than 80° C.

19. The method according to claim 17, which further comprises setting the temperature of the blown air to between 40° C. and 60° C., emitting the blown air flow from blown air nozzles, and selecting a configuration and a number of the blown air nozzles to provide a heat transfer coefficient $\alpha$ of a drying operation to be more than 250 W/m$^2$ K.

20. The method according to claim 17, which further comprises selecting a ratio of applied infrared radiation energy to an amount of applied blown air to be between 2 Wh per cubic meter of air and 20 Wh per cubic meter of air.

21. The method according to claim 20, which further comprises selecting the ratio to be between 2.5 and 12.5 Wh per cubic meter of air.

* * * * *